United States Patent [19]

Teuscher et al.

[11] Patent Number: 4,933,244

[45] Date of Patent: Jun. 12, 1990

[54] PHENOLIC EPOXY POLYMER OR POLYESTER AND CHARGE TRANSPORTING SMALL MOLECULE AT INTERFACE BETWEEN A CHARGE GENERATOR LAYER AND A CHARGE TRANSPORT LAYER

[75] Inventors: Leon A. Teuscher, Webster; Damodar M. Pai, Fairport, both of N.Y.

[73] Assignee: Xerox Corporation, Stamford, Conn.

[21] Appl. No.: 292,806

[22] Filed: Jan. 3, 1989

[51] Int. Cl.[5] ..... G03G 5/14

[52] U.S. Cl. ..... 430/58; 430/64; 430/96

[58] Field of Search ..... 430/49, 96, 58, 64

[56] References Cited

U.S. PATENT DOCUMENTS

| | | | |
|---|---|---|---|
| 3,140,174 | 7/1964 | Clark | 96/1 |
| 4,007,042 | 2/1977 | Buckley et al. | 96/1 PS |
| 4,150,987 | 4/1979 | Anderson et al. | 96/1.5 R |
| 4,256,823 | 3/1981 | Takahashi et al. | 430/66 |
| 4,439,507 | 3/1984 | Pan et al. | 430/96 |
| 4,464,450 | 8/1984 | Teuscher | 430/59 |
| 4,515,882 | 5/1985 | Mammino et al. | 430/58 |
| 4,579,801 | 4/1986 | Yashiki | 430/60 |
| 4,637,971 | 1/1987 | Takei et al. | 430/96 |
| 4,748,099 | 5/1988 | Shimada et al. | 430/96 |

*Primary Examiner*—John L. Goodrow

[57] ABSTRACT

An imaging member comprising an electrophotographic imaging member comprising a substrate having an electrically conductive surface, a charge generator layer, a charge transport layer comprising a polycarbonate film forming binder and a charge transporting small molecule, and an interface layer comprising a polymer and a charge transporting between the charge generator layer and the charge transport layer, wherein the interface layer comprises a mixture of a charge transporting material and certain phenolic epoxy polymers of polyesters.

20 Claims, No Drawings

PHENOLIC EPOXY POLYMER OR POLYESTER AND CHARGE TRANSPORTING SMALL MOLECULE AT INTERFACE BETWEEN A CHARGE GENERATOR LAYER AND A CHARGE TRANSPORT LAYER

BACKGROUND OF THE INVENTION

This invention relates in general to electrostatography and, more specifically, to an electrophotoconductive imaging member that is resistant to delamination.

In the art of xerography, a xerographic plate comprising a photoconductive insulating layer is imaged by first uniformly depositing an electrostatic charge on the imaging surface of the xerographic plate and then exposing the plate to a pattern of activating electromagnetic radiation such as light which selectively dissipates the charge in the illuminated areas of the plate while leaving behind an electrostatic latent image in the nonilluminated areas. This electrostatic latent image may then be developed to form a visible image by depositing finely divided electroscopic marking particles on the imaging surface.

A photoconductive layer for use in xerography may be a homogeneous layer of a single material such as vitreous selenium or it may be a composite layer containing a photoconductor and another material. One type of composite photoconductive layer used in electrophotography is illustrated in U.S. Pat. No. 4,265,990. A photosensitive member is described in this patent having at least two electrically operative layers. One layer comprises a photoconductive layer which is capable of photogenerating holes and injecting the photogenerated holes into a contiguous charge transport layer. Generally, where the two electrically operative layers are positioned on an electrically conductive layer with the photoconductive layer sandwiched between a contiguous charge transport layer and the conductive layer, the outer surface of the charge transport layer is normally charged with a uniform electrostatic charge and the conductive layer is utilized as an electrode. In flexible electrophotographic imaging members, the electrode is normally a thin conductive coating supported on a thermoplastic resin web. Obviously, the conductive layer may also function as an electrode when the charge transport layer is sandwiched between the conductive layer and a photoconductive layer which is capable of photogenerating holes and injecting the photogenerated holes into the charge transport layer. The charge transport layer in this embodiment, of course, must be capable of supporting the injection of photogenerated charges from the photoconductive layer and transporting the charges through the charge transport layer.

Various combinations of materials for charge generating layers and charge transport layers have been investigated. For example, the photosensitive member described in U.S. Pat. No. 4,265,990 utilizes a charge generating layer in contiguous contact with a charge transport layer comprising a polycarbonate resin and one or more of certain aromatic amine compounds. Various generating layers comprising photoconductive layers exhibiting the capability of photogeneration of holes and injection of the holes into a charge transport layer have also been investigated. Typical photoconductive materials utilized in the generating layer include amorphous selenium, trigonal selenium, and selenium alloys such as selenium-tellurium, selenium-tellurium-arsenic, selenium-arsenic, and mixtures thereof. The charge generation layer may comprise a homogeneous photoconductive material or particulate photoconductive material dispersed in a binder. Other examples of homogeneous and binder charge generation layer are disclosed in U.S. Pat. No. 4,265,990. Additional examples of binder materials such as poly(hydroxyether) resins are taught in U.S. Pat. No. 4,439,507. The disclosures of the aforesaid U.S. Pat. No. 4,265,990 and U.S. Pat. No. 4,439,507 are incorporated herein in their entirety. Photosensitive members having at least two electrically operative layers as disclosed above in, for example, U.S. Pat. No. 4,265,990 provide excellent images when charged with a uniform negative electrostatic charge, exposed to a light image and thereafter developed with finely developed electroscopic marking particles.

When one or more photoconductive layers are applied to a flexible supporting substrate, it has been found that the resulting photoconductive member may delaminate during flexing, particularly when the charge generator layer is formed from a vacuum deposited or sublimated material. Delamination can be especially acute when the photoreceptor is led around small small diameter support rods or drive roller. For example, photoreceptor delamination can sometimes be encountered in as few as 1,000 imaging cycles under the stressful conditions of being led around rollers having a diameter of about 2 cm. The use of adhesive interface layers containing an adhesive such as a phenoxy resin or certain polyesters causes surface potential to decline during cycling because the flow of charges is impeded.

Further, it has been found that during cycling of photoconductive imaging members containing a vacuum deposited $As_2Se_3$ charge generator layer, charge injection dark decay can reach unacceptable levels and render the photoconductive imaging member unsuitable for forming quality images.

INVENTION DISCLOSURE STATEMENT

U.S. Pat. No. 4,439,507 to Pan et al, issued Mar. 27, 1984—A photoreceptor is disclosed comprising a substrate, a conductive layer, a photogenerating layer and a charge transport layer. The photogenerating layer may comprise a resinous binder material of a poly(hydroxyether) material. The charge transport layer may contain a diamine charge transport molecule. The charge transport layer may also contain various resins including, for example, poly(hydroxyether) binders, polyesters, epoxies as well as block, random or alternating copolymers thereof.

U.S. Pat. No. 4,515,882 to Mammino et al, issued Mar. 7, 1985—An electrophotographic imaging member is disclosed comprising at least one photoconductive layer and an overcoating layer comprising a film forming continuous phase comprising charge transport molecules and finely divided charge injection enabling particles dispersed in the continuous phase. The charge transport layer may also contain various resins including, for example, poly(hydroxyether) binders, polyesters, epoxy resins as well as block, random or alternating copolymers thereof.

U.S. Pat. No. 4,150,987 to Anderson et al, issued Apr. 29, 1979—An electropotographic plate is disclosed comprising a conventional charge generation material and a p-type hydrazone containing charge transport layer. The charge transport layer may contain a polyester resin. Various brands of polyesters are described, for example, in Examples 2b–f and 5a–e.

U.S. Pat. No. 4,464,450 to L. Teuscher, issued Aug. 7, 1984—An amino silane blocking layer is disclosed for use in photoreceptors comprising a substrate, a conductive layer, a photogenerating layer and a charge transport layer.

U.S. Pat. No. 4,637,971 to Takei et al, issued Jan. 20, 1987—A photoreceptor is disclosed in which various polycarbonate binders may be used in a photosensitive layer.

U.S. Pat. No. 4,007,042 to Buckely et al, issued Feb. 8, 1977—A migration imaging member is disclosed comprising a substrate overcoated with a softenable layer and a migration marking material. The softenable layer may contain various resins listed, for example, in column 6, lines 15–28. Among the list are included phenolic resins; epoxy resins; and mixtures of copolymers thereof.

U.S. Pat. No. 3,140,174 to Clark, issued July 7, 1967—An overcoated photoreceptor is disclosed in which the overcoating may contain various resins listed, for example, in column 3, lines 11–22. These resins include polyester resins and epoxides.

U.S. Pat. No. 4,579,801 to Yashiki, issued Apr. 1, 1986—An electrophotographic imaging member is disclosed having a phenolic resin layer formed from a resol coat, between a substrate and a photosensitive layer. The photosensitive layer may be a single layer or a divided layer made up of a charge generating layer and a charge transport layer. The charge transport layer may contain various resins including, for example a polyester resin.

U.S. Pat. No. 4,256,823 to Takahashi, issued Mar. 17, 1981—An electrophotographic imaging member is disclosed comprising a photoconductive insulating binder layer and an clearcoling layer formed by applying a dispersion of a organic high polymer on the photoconductive insulating binder layer. The clearcoling layer may contain, for example, an epoxy resin.

Thus, the characteristics of electrostatographic imaging members comprising a supporting substrate, charge generator layer and charge transport layer exhibit deficiencies which are undesirable in automatic, cyclic electrostatographic copiers, duplicators, and printers.

SUMMARY OF THE INVENTION

It is an object of the invention to provide an electrophotographic imaging member which overcomes the above-noted disadvantages.

It is an another object of this invention to provide an electrophotographic imaging member with improved resistance to delamination.

It is another object of this invention to provide an electrophotographic imaging member which minimizes charge injection dark decay.

It is still another object of this invention to provide an electrophotographic imaging member which provides stable image development.

The foregoing objects and others are accomplished in accordance with this invention by providing an imaging member comprising an electrophotographic imaging member comprising a substrate having an electrically conductive surface, a charge generator layer, a charge transport layer comprising a polycarbonate film forming binder and a charge transporting small molecule, and an interface layer comprising a polymer and a charge transporting small molecule uniformly distributed along at least the interface between said charge generator layer and said charge transport layer, wherein said interface layer comprises a mixture of a charge transporting material and a polymer selected from the group consisting of a phenolic epoxy polymer represented by the following structure:

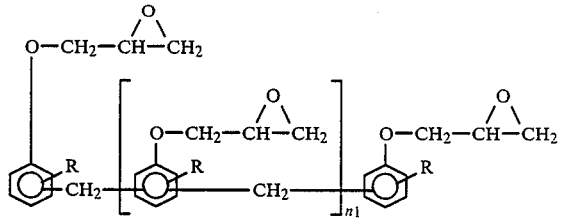

wherein R is hydrogen or an alkyl group containing from 1 to 8 carbon atoms and $n_1$ is a number from 1 to 8 and a polyester represented by the following structure:

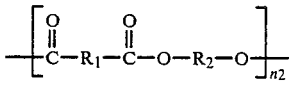

wherein $R_1$ and $R_2$ are an alkyl group having from 1 to/2 carbon atoms, a cycloalkyl group containing from 4 to 36 carbon atoms, an aryl group, or an alkylaryl group containing from 1 to 8 carbon atoms in the alkyl group, and $n_2$ is a number from 4 to 1,000. The charge transporting material can be the same as that in the transport layer or, if it is different from that in the transport layer, the ionization potential ($I_p$) should be equal to or larger than the $I_p$ of the transporting substance in the transport layer. For example, if the charge transporting molecule in the transport layer is a diamine, the charge transporting material in the interface layer can be a diamine.

Although the supporting substrate layer having an electrically conductive surface may be a conventional rigid substrate, maximum benefit is derived from an increased resistance to delamination for flexible supporting substrate layers having an electrically conductive surface. The flexible supporting substrate layer having an electrically conductive surface may be opaque or substantially transparent and may comprise numerous suitable materials having the required mechanical properties. For example, it may comprise an underlying flexible insulating support layer coated with a flexible electrically conductive layer, or merely a flexible conductive layer having sufficient internal strength to support the electrophotoconductive layer. The flexible electrically conductive layer, which may comprise the entire supporting substrate or merely be present as a coating on an underlying flexible web member, may comprise any suitable electrically conductive material including, for example, aluminum, titanium, nickel, chromium, brass, gold, stainless steel, carbon black, graphite and the like. The flexible conductive layer may vary in thickness over substantially wide ranges depending on the desired use of the electrophotoconductive member. Accordingly, the conductive layer can generally range in thicknesses of from about 50 Angstrom units to many centimeters. When a highly flexible photoresponsive imaging device is desired, the thickness of the conductive layer may be between about 100 Angstrom units to about 750 Angstrom units. Any underlying flexble support layer may be of any suitable material. Typical underlying flexible support layers of film forming polymers include insulating non-conducting materials comprising various resins such as polycarbonate resins, polyethylene terephthalate resin, polyimide resins, polyamide resin, and the like. The coated or uncoated flexible supporting substrate layer may have any number of different configurations such as, for example, a sheet, a scroll, an endless flexible belt, and the like. Preferably, the insulating web is in the form of an endless flexible belt and comprises a commercially available polyethylene terephthalate resin (Mylar, available from E.I. duPont de Nemous & Co.).

Preferably, a suitable charge blocking layer may be interposed between the conductive layer and the electrophotographic imaging layer. Some materials can form a layer which functions as both an adhesive layer and charge blocking layer. Any suitable blocking layer material capable of trapping charge carriers may be utilized. Typical blocking layers include polyvinylbutyral, organosilanes, epoxy resins, polyesters, polyamides, polyurethanes, silicones and the like. If a resin is employed in the blocking layer, it should preferably have a molecular weight of between about 600 and about 200,000 and glass transition temperature of at least about 5° C. The polyvinylbutyral, epoxy resins, polyesters, polyamides, and polyurethanes can also serve as an adhesive layer. Charge blocking layers preferably have a dry thickness between about 0.005 micrometer and about 0.2 micrometers. Adhesive layers preferably have a dry thickness between about 0.01 micrometer and about 2 micrometers.

It has been found that when charge generator layers are formed from vacuum deposited or sublimated photoconductive materials such as $As_2Se_3$, amorphous selenium containing tellurium, perylene, phthalocyanine, bisazo pigments, and the like, charge injection dark decay can reach unacceptable levels and render the photoconductive imaging member unsuitable for forming quality images. Such charge injection dark decay can be markedly reduced by the use of a blocking layer comprising an amino silane reaction product, a polyvinyl butyral or polyvinyl pyrrolidone and the like.

The silane reaction product described in U.S. Pat. No. 4,464,450 is particularly preferred as a blocking layer material because cyclic stability is extended. The specific silanes employed to form the preferred blocking layer are identical to the preferred silanes employed to treat the crystalline particles of this invention. In other words, silanes having the following structural formula:

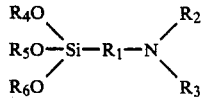

wherein $R_1$ is an alkylidene group containing 1 to 20 carbon atoms, $R_2$ and $R_3$ are independently selected from the group consisting of H, a lower alkyl group containing 1 to 3 carbon atoms, a phenyl group and a poly(ethyleneamino) group, and $R_4$, $R_5$, and $R_6$ are independently selected from a lower alkyl group containing 1 to 4 carbon atoms. Typical hydrolyzable silanes include 3-aminopropyltriethoxysilane, N-aminoethyl-3-aminopropyltrimethoxysilane, N-2-aminoethyl-3-aminopropyltrimethoxysilane, N-2-aminoethyl-3-aminopropyltris(ethylethoxy) silane, p-aminophenyl trimethoxysilane, 3-aminopropyldiethylmethylsilane, (N,N'-dimethyl 3-amino)propyltriethoxysilane, 3-aminopropylmethyldiethoxysilane, 3-aminopropyl trimethoxysilane, N-methylaminopropyltriethoxysilane, methyl[2-(3-trimethoxysilylpropylamino)ethylamino]-3-propanoate, (N,N'-dimethyl 3-amino)propyl triethoxysilane, N,N-dimethylaminophenyltriethoxy silane, trimethoxysilylpropyldiethylenetriamine and mixtures thereof. The blocking layer forming hydrolyzed silane solution may be prepared by adding sufficient water to hydrolyze the alkoxy groups attached to the silicon atom to form a solution. Insufficient water will normally cause the hydrolyzed silane to form an undesirable gel. Generally, dilute solutions are preferred for achieving thin coatings. Satisfactory reaction product layers may be achieved with solutions containing from about 0.1 percent by weight to about 1 percent by weight of the silane based on the total weight of solution. A solution containing from about 0.01 percent by weight to about 2.5 percent by weight silane based on the total weight of solution are preferred for stable solutions which form uniform reaction product layers. The pH of the solution of hydrolyzed silane is carefully controlled to obtain optimum electrical stability. A solution pH between about 4 and about 10 is preferred. Optimum blocking layers are achieved with hydrolyzed silane solutions having a pH between about 7 and about 8, because inhibition of cycling-up and cycling-down characteristics of the resulting treated photoreceptor maximized. Control of the pH of the hydrolyzed silane solution may be effected with any suitable organic or inorganic acid or acidic salt. Typical organic and inorganic acids and acidic salts include acetic acid, citric acid, formic acid, hydrogen iodide, phosphoric acid, ammonium chloride, hydrofluorosilicic acid, Bromocresol Green, Bromophenol Blue, p-toluene sulphonic acid and the like.

Any suitable technique may be utilized to apply the hydrolyzed silane solution to the conductive layer. Typical application techniques include spraying, dip coating, roll coating, wire wound rod coating, and the like. Generally, satisfactory results may be achieved when the reaction product of the hydrolyzed silane forms a blocking layer having a thickness between about 20 Angstroms and about 2,000 Angstroms. This siloxane coating is described in U.S. Pat. No. 4,464,450, issued Aug. 7, 1984 to Leon A. Teuscher, the disclosure of this patent being incorporated herein in its entirety.

Other preferred blocking layers materials are polyvinyl butyral and polyvinyl pyrrolidone. These film forming polymers polymers preferably have a weight average molecular weight of between about 2,000 and about 200,000.

In some cases, intermediate layers between the blocking layer and the adjacent charge generating or photogenerating material may be desired to improve adhesion or to act as an electrical barrier layer. If such layers are utilized, they preferably have a dry thickness between about 0.01 micrometer to about 2 micrometers. Typical adhesive layers include film-forming polymers such as polyester, polyvinylbutyral, polyvinylpyrrolidone, polyurethane, polymethyl methacrylate and the like.

Generally, the electrophotoconductive imaging member of this invention comprises a substrate having an electrically conductive surface, a charge generator layer, a charge transport layer and an interface layer containing a polymer mixed with a charge transporting small molecule uniformly distributed along at least the interface between the charge generator layer and the transport layer, wherein the interface polymer is selected from certain phenolic epoxy polymers and certain polyesters.

The charge generating layer may contain homogeneous, heterogeneous, inorganic or organic photoconductive compositions. One example of photoconductive compositions containing a heterogeneous composition is described in U.S. Pat. No. 3,121,006 wherein finely divided particles of a photoconductive inorganic compound is dispersed in an electrically insulating organic resin binder. The entire disclosure of this patent is incorporated herein by reference. Other well known photoconductive compositions include amorphous selenium, halogen doped amorphous selenium, amorphous selenium alloys including selenium arsenic, selenium tellurium, selenium arsenic antimony, and halogen doped selenium alloys, cadmium sulfide and the like. Often, the inorganic selenium based photoconductive materials are deposited as a relatively homogeneous layer. Moreover, many of these inorganic materials may be deposited by vacuum deposition techniques, particularly the selenium, selenium alloy and arsenic triselenide materials.

Other typical charge generating materials include metal free phthalocyanine described in U.S. Pat. No. 3,357,989, metal phthalocyanines such as copper phthalocyanine and vanadyl phthalocyanine, perylene, quinacridones available from DuPont under the tradename Monastral Red, Monastral Violet and Monastral Red Y, substituted 2,4-diamino-triazines disclosed in U.S. Pat. No. 3,442,781, polynuclear aromatic quinones available from Allied Chemical Corporation under the tradename Indofast Double Scarlet, Indofast Violet Lake B, Indofast Brilliant Scarlet and Indofast Orange; chlorodiane blue; dibromoanthanthrone; thiapyrilium, diazo compounds; triaszo compounds; squaraines; and the like. The disclosures of U.S. Pat. No. 3,357,989 and U.S. Pat. No. 3,442,781 are incorporated herein by reference in their entirety. Some organic charge generating materials such as phthalocyanine, perylenes and like can be deposited by sublimation.

Any suitable inactive resin binder material may be empolyed in the charge generator layer of photoreceptors having generator layers comprising a mixture of a resin binder and photoconductive material. Typical organic resinous binders include polycarbonates, acrylate polymers, vinyl polymers, cellulose polymers, polyesters, polysiloxanes, polyamides, polyurethanes, epoxies, and the like. Many organic resinous binders are disclosed, for example, in U.S. Pat. No. 3,121,006 and U.S. Pat. No. 4,439,507, the entire disclosures of which are incorporated herein by reference. Organic resinous polymers may be block, random or alternating copolymers. The photogenerating composition or pigment is present in the resinous binder composition in various amounts in heterogeneous binder layers. When using an electrically inactive or insulating resin, it is essential that there be particle-to-particle contact between the photoconductive particles. This necessitates that the photoconductive material be present in an amount of at least about 15 percent by volume of the binder layer with no limit on the maximum amount of photoconductor in the binder layer. If the matrix or binder comprises an active material, e.g. poly-N-vinylcarbazole, a photoconductive material need only to comprise about 1 percent or less by volume of the binder layer with no limitation on the maximum amount of photoconductor in the binder layer. Generally for generator layers containing an electrically active matrix or binder such as polyvinyl carbazole or poly(methyl phenyl silylene), from about 5 percent by volume to about 60 percent by volume of the photogenerating pigment is dispersed in about 40 percent by volume to about 95 percent by volume of binder, and preferably from about 7 percent to about 30 percent by volume of the photogenerating pigment is dispersed in from about 70 percent by volume to about 93 percent by volume of the binder. The specific proportions selected also depends to some extent on the thickness of the generator layer. If desired, the charge generating layer may contain between about 0.5 percent by weight to about 5 percent by weight of phenoxy epoxy resin or a polyester, based on the total weight by layer.

The thickness of the photogenerating binder layer is not particularly critical. Layer thicknesses from about 0.05 micrometer to about 40.0 micrometers have been found to be satisfactory. The photogenerating binder layer containing photoconductive compositions and/or pigments, and the resinous binder material preferably ranges in thickness of from about 0.1 micrometer to about 5.0 micrometers, and has an optimum thickness of from about 0.3 micrometer to about 3 micrometers for best light absorption and improved dark decay stability and mechanical properties. A layer thickness of between about 0.1 micrometer and about 1 micrometer is preferred for homogeneous vacuum deposited or sublimated photogenerator materials because almost complete absorption of incident radiation is achieved in these thicknesses.

Other typical photoconductive layers include amorphous or alloys of selenium such as arsenic triselenide, selenium-arsenic, selenium-tellurium-arsenic, selenium-tellurium, trigonal selenium and the like dispersed in a film forming binder.

The active charge transport layer should be capable of supporting the injection of photo-generated holes and electrons from the charge generator layer and allowing the transport of these holes or electrons through the charge transport layer to selectively discharge the surface charge. The active charge transport layer not only serves to transport holes or electrons, but also protects the photoconductive layer from abrasion or chemical attack and therefor extends the operating life of the photoreceptor imaging member. The charge transport layer should exhibit negligible, if any, discharge when exposed to a wavelength of light useful in xerography, e.g. 4000 Angstroms to 8000 Angstroms. Therefore, the charge transport layer is substantially transparent to radiation in a region in which the photoconductor is to be used. Thus, the active charge transport layer is a substantially non-photoconductive material which supports the injection of photogenerated holes from the generation layer. The active transport layer is normally transparent when exposure is effected through the active layer to ensure that most of the incident radiation is utilized by the underlying charge carrier generator layer for efficient photogenertion. When used with a transparent substrate, imagewise exposure may be accomplished through the substrate with all light passing through the substrate. In this case, the active transport material need not be absorbing in the wavelength region of use. The charge transport layer in conjunction with the generation layer in the instant invention is a material which is an insulator to the extent that an electrostatic charge placed on the transport layer is not conductive in the absence of illumination, i.e. a rate sufficient to prevent the formation and retention of an electrostatic latent image thereon.

The active charge transport layer may comprise an activating compound useful as an additive dispersed in electrically inactive polymeric film forming binder materials making these materials electrically active. These charge transporting small molecule compounds are added to polymeric film forming binder component which are incapable of supporting the injection of photogenerated holes from the generation material and incapable of allowing the transport of these holes therethrough. This will convert the electrically inactive polymeric material to a material capable of supporting the injection of photogenerated holes from the generation material and capable of allowing the transport of these holes through the active layer in order to discharge the surface charge on the active layer.

Preferred electrically active layers comprise an electrically inactive resin material, e.g. a polycarbonate made electrically active by the addition of one or more of the following compounds poly-N-vinylcarbazole; poly-1-vinylpyrene; poly-9-vinylanthracene; polyacenaphthalene; poly-9-(4-pentenyl)-carbazole; poly-9-(5-hexyl)-carbazole; polymethylene pyrene; poly-1-(pyrenyl)-butadiene; N-substituted polymeric acrylic acid amides of pyrene; chlorodiane blue; N,N'-diphenyl-N,N'-bis(phenylmethyl)-[1,1'-biphenyl]-4,4'-diamine; N,N'-diphenyl-N,N'-bis(3-methylphenyl)-2,2'-dimethyl-1,1'-biphenyl-4,4'-diamine and the like.

Non-film forming charge transporting small molecule materials include following:

Diamine transport molecules of the types described in U.S. Pat. Nos. 4,306,008, 4,304,829, 4,233,384, 4,115,116, 4,299,897, 4,265,990 and 4,081,274. Typical diamine transport molecules include N,N'-diphenyl-N,N'-bis(alkylphenyl)-[1,1'-biphenyl]-4,4'-diamine wherein the alkyl is, for example, methyl, ethyl, propyl, n-butyl, etc. such as N,N'-diphenyl-N,N'-bis(3''-methylphenyl)-[1,1'-biphenyl]-4,4'-diamine, N,N'-diphenyl-N,N'-bis(4-methylphenyl)-[1,1'-biphenyl]-4,4'-diamine, N,N'-diphenyl-N,N'-bis(2-methylphenyl)-[1,1'-biphenyl]-4,4'-diamine, N,N'-diphenyl-N,N'-bis(3-ethylphenyl)-[1,1'-biphenyl]-4,4'-diamine, N,N'-diphenyl-N,N'-bis(4-ethylphenyl)-[1,1'-biphenyl]-4,4'-diamine, N,N'-diphenyl-N,N'-bis(4-n-butylphenyl)-[1,1'-biphenyl]-4,4'-diamine, N,N'-diphenyl-N,N'-bis(3-chlorophenyl)-[1,1'-biphenyl]-4,4'-diamine, N,N'-diphenyl-N,N'-bis(4-chlorophenyl)-[1,1'-biphenyl]-4,4'-diamine, N,N'-diphenyl-N,N'-bis(phenylmethyl)-[1,1'-biphenyl]-4,4'-diamine, N,N,N',N'-tetraphenyl-[2,2'-dimethyl-1,1'-biphenyl]-4,4'-diamine, N,N,N',N'-tetra(4-methylphenyl)-[2,2'-dimethyl-1,1'-biphenyl]-4,4'-diamine, N,N'-diphenyl-N,N'-bis(4-methylphenyl)-[2,2'-dimethyl-1,1'-biphenyl]-4,4'-diamine, N,N'-diphenyl-N,N'-bis(2-methylphenyl)-[2,2'-dimethyl-1,1'-biphenyl]-4,4'-diamine, N,N'-diphenyl-N,N'-bis(3-methylphenyl)-[2,2'-dimethyl-1,1'-biphenyl]-4,4'-diamine, N,N'-diphenyl-N,N'-bis(3-methylphenyl)-pyrenyl-1,6-diamine, and the like. Pyrazoline transport molecules as disclosed in U.S. Pat. Nos. 4,315,982, 4,278,746, and 3,837,851. Typical pyrazoline transport molecules include 1-[lepidyl-(2)]-3-(p-diethylaminophenyl)-5-(p-diethylaminophenyl)pyrazoline, 1-[quinolyl-(2)]-3-(p-diethylaminophenyl)-5-(p-diethylaminophenyl)pyrazoline, 1-[pyridyl-(2)]-3-(p-diethylaminostyryl)-5-(p-diethylaminophenyl)pyrazoline, 1-[6-methoxypyridyl-(2)]-3-(p-diethylaminostyryl)-5-(p-diethylaminophenyl) pyrazoline, 1-phenyl-3-[p-dimethylaminostyryl]-5-(p-dimethylaminostyryl)pyrazoline, 1-phenyl-3-[p-diethylaminostyryl]-5-(p-diethylaminostyryl)pyrazoline, and the like. Substituted fluorene charge transport molecules as described in U.S. Pat. No. 4,245,021. Typical fluorene charge transport molecules include 9-(4'-dimethylaminobenzylidene)fluorene, 9-(4'-methoxybenzylidene)fluorene, 9-(2',4'-dimethoxybenzylidene)fluorne, 2-nitro-9-benzylidene-fluorene, 2-nitro-9-(4'-diethylaminobenzylidene)fluorene and the like. Oxadiazole transport molecules such as 2,5-bis(4-diethylaminophenyl)-1,3,4-oxadiazole, pyrazoline, imidazole, triazole, and others described in German Pat. Nos. 1,058,836, 1,060,260 and 1,120,875 and U.S. Pat. No. 3,895,944. Hydrazone transport molecules including p-diethylaminobenzaldehyde(diphenylhydrazone), o-ethoxy-p-diethylaminobenzaldehyde(diphenylhydrazone), o-methyl-p-diethylaminobenzaldehyde(diphenylhydrazone), o-methyl-p-dimethylaminobenzaldehyde(diphenylhydrazone), p-dipropylaminobenzaldehyde-(diphenylhydrazone), p-diethylaminobenzaldehyde-(benzylphenylhydrazone), p-dibutylaminobenzaldehyde-(diphenylhydrazone), p-dimethylaminobenzaldehyde-(diphenylhydrazone) and the like described, for example in U.S. Pat. No. 4,150,987. Other hydrazone transport molecules include compounds such as 1-naphthalenecarbaldehyde 1-methyl-1-phenylhydrazone, 1-naphthalenecarbaldehyde 1,1-phenylhydrazone, 4-methoxynaphthlene-1-carbaldehyde 1-methyl-1-phenylhydrazone and other hydrazone transport molecules described, for example in U.S. Pat. Nos. 4,385,106, 4,338,388, 4,387,147, 4,399,208 and 4,399,207. Another charge transport molecule is a carbazole phenyl hydrazone such as 9-methylcarbazole-3-carbaldehyde-1,1-diphenylhydrazone, 9-ethylcarbazole-3-carbaldehyde-1-methyl-1-phenylhydrazone, 9-ethylcarbazole-3-carbaldehyde-1-ethyl-1-phenylhydrazone, 9-ethylcarbazole-3-carbaldehyde-1-ethyl-1-benzyl-1-phenylhydrazone, 9-ethylcarbazole-3-carbaldehyde-1,1-diphenylhydrazone, and other suitable carbazole phenyl hydrazone transport molecules described, for example, in U.S. Pat. No. 4,256,821. Similar hydrazone transport molecules are described, for example, in U.S. Pat. No. 4,297,426. Tri-substituted methanes such as alkyl-bis(N,N-dialkylaminoaryl)methane, cycloalkyl-bis(N,N-dialkylaminoaryl)methane, and cycloalkenyl-bis(N,N-dialkylaminoaryl)methane as described, for example, in U.S. Pat. No. 3,820,989. 9-fluorenylidene methane derivatives including (4-n-butoxycarbonyl-9-fluorenylidene)malonontrile, (4-phenethoxycarbonyl-9-fluorenylidene)malonontrile, (4-carbitoxy-9-fluorenylidene)malonontrile, (4-n-butoxycarbonyl-2,7-dinitro-9-fluorenylidene)malonate, and the like. Other typical transport materials include the numerous transparent organic non-polymeric transport materials described in U.S. Pat. No. 3,870,516 and the nonionic compounds described in U.S. Pat. No. 4,346,157. The disclosures of each of the patents identified above pertaining to charge transport molecule which are soluble or dispersible on a molecular scale in a film forming binder are incorporated herein in their entirety.

An especially preferred transport layer employed in one of the two electrically operative layers in the multilayer photoconductor of this invention comprises from about 25 to about 75 percent by weight of at least one charge transporting aromatic amine compound, and about 75 to about 15 percent by weight of a polymeric film forming resin in which the aromatic amine is soluble.

The charge transport layer forming mixture preferably comprises an aromatic amine compound of one or more compounds having the general formula:

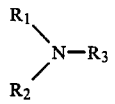

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms. The substituents should be free form electron withdrawing groups such as $NO_2$ groups, CN groups, and the like. Typical aromatic amine compounds that are represented by this structural formula include:

I. Triphenyl amines such as:

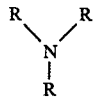

II. Bis and poly triarylamines such as:

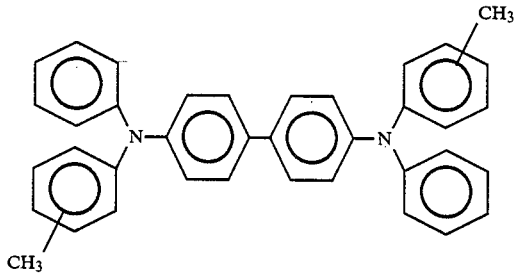

III. Bis arylamine ether such as:

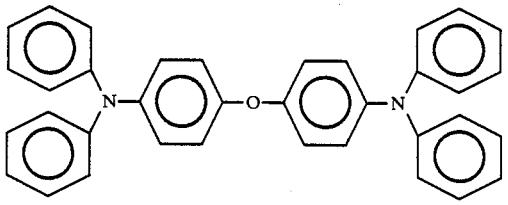

IV. Bis alkyl-arylamines such as:

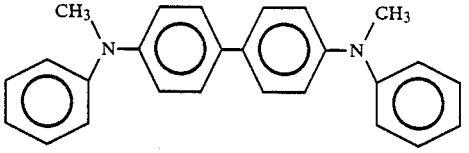

A preferred aromatic amine compound has the general formula:

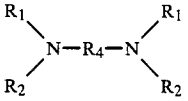

wherein $R_1$, and $R_2$ are defined above and $R_4$ is selected from the group consisting of a substituted or unsubstituted biphenyl group, diphenyl ether group, alkyl group having from 1 to 18 carbon atoms, and cycloaliphatic group having from 3 to 12 carbon atoms. The substituents should be free form electron withdrawing groups such as $NO_2$ groups, CN groups, and the like.

Excellent results in controlling dark decay and background voltage effects have been achieved when the imaging members doped in accordance with this invention comprising a charge generation layer comprise a layer of photoconductive material and a contiguous charge transport layer of a polycarbonate resin material having a molecular weight of from about 20,000 to about 250,000 having dispersed therein from about 25 to about 75 percent by weight of one or more compounds having the general formula:

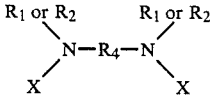

wherein $R_1$, $R_2$, and $R_4$ are defined above and X is an aryl group substituted with a group selected from the group consisting of an alkyl group having from 1 to about 4 carbon atoms and chlorine, the photoconductive layer exhibiting the capability of photogeneration of holes and injection of the holes and the charge transport layer being substantially non-absorbing in the spectral region at which the photoconductive layer generates and injects photogenerated holes but being capable of supporting the injection of photogenerated holes from the photoconductive layer and transporting said holes through the charge transport layer.

Examples of charge transporting aromatic amines represented by the structural formulae above for charge transport layers capable of supporting the injection of photogenerated holes of a charge generating layer and transporting the holes through the charge transport layer include triphenylmethane, bis(4-diethylamine-2-methylphenyl) phenylmethane; 4′-4″-bis(diethylamino)-2′,2″-dimethyltriphenyl-methane, N,N′-bis(alkylphenyl)-[1,1′-biphenyl]-4,4′-diamine wherein the alkyl is, for example, methyl, ethyl, propyl, n-butyl, etc., N,N′-diphenyl-N,N′-bis(chlorophenyl)-[1,1′-biphenyl]-4,4′-diamine, N,N′-diphenyl-N,N′-bis(3″-methylphenyl)-(1,1′-biphenyl)-4,4′-diamine, and the like dispersed in an inactive resin binder.

Any suitable inactive polycarbonate resin binder soluble in suitable solvent may be employed in the process of this invention. Generally, the polycarbonate film forming binders may be represented by the formula

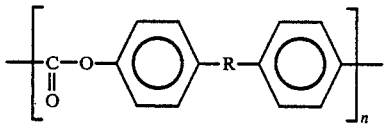

wherein R is is a divalent group selected from the group consisting of alkylidene, phenylidene, or cycloalkylidene and n is a number from 10 to 1,000. Typical R groups include, for example, isopropylidene, cyclohexylidene, ethylidene, isobutylidene, phenylethylidene, decahydronapthylidene, and the like. Typical inactive polycarbonate resin binders include poly(4,4'-isopropylidenediphenyl carbonate), poly[1,1-cyclohexylidenebis(4-phenyl)carbonate], poly(phenolphthalein carbonate), poly(diphenylmethane bis-4-phenyl carbonate), poly[2,2-(4-methylpentatne)bis-4-phenyl carbonate], and and the like. Molecular weights can vary from about 20,000 to about 250,000. Other specific examples of polycarbonate resins are described, for example, in U.S. Pat. No. 4,637,971, the entire disclosure thereof incorporated herein by reference.

The preferred electrically inactive resin materials are polycarbonate resins have a molecular weight from about 20,000 to about 250,000 more preferably from about 50,000 to about 100,000. The materials most preferred as the electrically inactive resin material is poly(4,4'-dipropylidene-diphenylene carbonate) with a molecular weight of from about 35,000 to about 40,000, available as Lexan 145 from General Electric Company; poly(4,4'-isopropylidene-diphenylene carbonate) with a molecular weight of from about 40,000 to about 45,000, available as Lexan 141 from the General Electric Company; a polycarbonate resin having a molecular weight of from about 50,000 to about 100,000, available as Makrolon from Farbenfabricken Bayer A. G.; a polycarbonate resin having a molecular weight of from about 20,000 to about 50,000 available as Merlon from Mobay Chemical Company and poly[1,1-cyclohexylidenebis(4-phenyl)carbonate].

In all of the above charge transport layers, the activating compound which renders the electrically inactive polymeric material electrically active should be present in amounts of from about 15 to about 75 percent by weight. The activating compound is preferably present in the range of between about 30 percent and about 60 percent because the presence of excessive transport material causes adversely affects the mechanical properties of the layers.

The imaging member of this invention contains an interface layer containing a polymer and a charge transport molecule uniformly distributed along at least the interface between the charge generator layer and the transport layer. This interface polymer is selected from certain specific phenolic epoxy polymers or certain specific polyesters. The phenolic epoxy polymer is represented by the following structure:

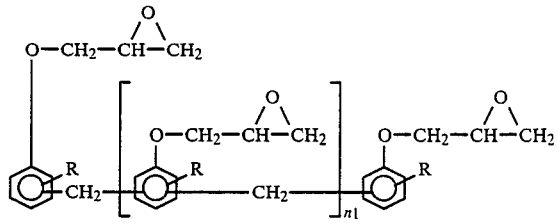

wherein R is hydrogen or an alkyl group containing from 1 to 8 carbon atoms and $n_1$ is a number from 1 to 8. Specific preferred phenolic epoxy polymers include ECN 1235, ECN 1299 and EPN 1138, available from CIBA Chemical & Dye Co. and DEN 438, available from Dow Chemical Co.

The polyester is represented by the following structure:

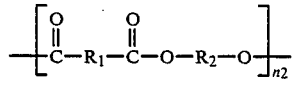

wherein $R_1$ and $R_2$ are an alkyl group having from 1 to 12 carbon atoms or a cycloalkyl group containing from 4 to 36 carbon atoms or an aryl group, or an alkylaryl group containing from 1 to 8 carbon atoms in the alkyl group, and $n_2$ is a number from 4 to 1000. Examples of aliphatic groups for the polyester include those containing from about 1 carbon atom to about 30 carbon atoms, such as methyl, ethyl, propyl, butyl, pentyl, hexyl, heptyl, decyl, pentadecyl, eicodecyl, and the like. Preferred aliphatic groups include alkyl group containing from about 1 carbon atom to about 6 carbon atoms, such as methyl, ethyl, propyl, and butyl. Illustrative examples of aromatic groups include those containing from about 6 carbon atoms to about 25 carbon atoms, such as phenyl, naphthyl, anthryl, and the like, with phenyl being preferred. The aliphatic and aromatic groups can be substituted with various known substituents, including for example, alkyl, halogen, nitro, sulfo and the like. Typical cycloalkyl groups include cyclohexyl, cyclobutyl, cyclooctyl, and the like. The aliphatic and aromatic groups can be substituted with various known substituents, including for example, alkyl, halogen, nitro, sulfo and the like. Specific preferred polyester resins include PE 200 and PE 100, available from Goodyear Tire & Rubber Co. and 49000, available from E. I. duPont de Nemours & Co.

Any suitable charge transport molecule may be utilized in the interface layer. Typical charge transport molecules include the diamine molecules of the type described in U.S. Pat. Nos. 4,306,008, 4,304,829, 4,233,384, 4,115,116, 4,299,897, 4,265,990 and 4,081,274; pyrazoline transport molecules as described in U.S. Pat. Nos. 4,315,982; 4,278,746 and 3,837,851; benzaldehydehydrazones as described in U.S. Pat. No. 4,150,987; and other hydrazone molecules described in U.S. Pat. Nos. 4,385,106, 4,338,388, 4,387,147, 4,399,208 and 4,399,207, the entire disclosures of these charge transport molecule patents being incorporated herein by reference. It is preferred to employ the same charge transport molecule in both the transport layer and the interface layers. In the event that the charge transport molecules are different in these layers, the ionization potential ($l_p$) of the molecule in the adhesion promoting interface layer should be greater than the $l_p$ of the molecule in the transport layer.

When these phenolic epoxy polymers or polyesters are supplied to the interface between the charge generating layer and the charge transport layer as a component in the charge transport layer instead of as a separate interface layer, the phenolic epoxy polymer or polyester must be miscible with the film forming binder component, the charge transport material (which may be also be the film forming binder component) and any solvent employed to apply the transport layer as coating. The transport layer, after drying or curing, contains the phenolic epoxy polymer or polyester in the form of a solid solution or molecular dispersion in the film forming binder component. A solid solution is defined as a composition in which at least one component is dissolved in another component and which exists as a homogeneous solid phase. A molecular dispersion is defined as a composition in which particles of at least one component are dispersed in another component, the dispersion of the particles being on a molecular scale. A solid solution or molecular dispersion of the phenolic epoxy polymer or polyester of this invention in the film forming binder component of the charge transport layer is necessary to assure transparency of the transport layer. If the phenolic epoxy polymer or polyester is immiscible, phase separation results in an opaque transport layer and also results in unacceptable charge trapping. The phenolic epoxy polymers or polyesters should be present in small concentrations of less than about 10 percent by weight and more than about 0.5 percent by weight, based on the total weight of the transport layer to increase adhesion between the generator and transport layers.

The use of poly(hydroxyether) binders in charge transport layers have been disclosed, for example, in U.S. Pat. No. 4,439,507. This latter compound phase separates from polycarbonate charge transport binders whereas the phenolic epoxy compound of this invention forms a solid solution with polycarbonates. Phase separation of the poly(hydroxyether) binder from polycarbonate charge transport binder causes charge trapping in the transport layer resulting in residual potential build up with multiple cycle operation. This results in unacceptable background print out in the final copies.

The use of polyester resins in charge transport layers have been disclosed, for example, in U.S. Pat. No. 4,439,507, U.S. Pat. No. 4,515,882, and U.S. Pat. No. 4,150,987. In U.S. Pat. No. 4,150,987, among the the specific polyesters disclosed in Examples 2b–f and 5a–e, it has been found that diamine charge transport molecules dissolve only in small concentrations in PE-200 polymer (available from Goodyear Tire & Rubber Co.) and 49,000 polymer (available from E. I. duPont de Nemours & Co.). Nevertheless, these layers provide adequate charge transport when used as a thin interface film between the generator and transport layers but are not adequate when employed as thick transport layer films. Since preferred diamine charge transport molecules has limited solubility in PE-200 (Goodyear) and 49,000 (duPont) in the presence of polycarbonate and diamine charge transport material, these materials impede the flow of charge during imagewise exposure when present in concentrations exceeding about 10 percent by weight, based on the total weight of the transport layer.

Any suitable and conventional technique may be utilized to mix and thereafter apply the interface layer or charge transport layer coating mixture to the charge generating layer. Typical application techniques include spraying, dip coating, roll coating, wire wound rod coating, and the like. Drying of the deposited coating may be effected by any suitable conventional technique such as oven drying, infra red radiation drying, air drying and the like. Generally, the thickness of the transport layer is betweeen about 5 micrometers to about 100 micrometers, but thicknesses outside this range can also be used. A layer thickness of between about 5 micrometers and about 35 micrometers is preferred because it provides adequate contrast potentials. If the phenolic epoxy polymers or polyesters mixed with charge transport molecule of this invention are supplied to the interface between the charge generating layer and the charge transport layer as a separate interface layer instead as of as an additive in the charge transport layer, the interface layer preferably has a thickness between about micrometer 0.005 and about 2.0 micrometer because the lower limit assures improved adhesion and the upper limit is set by the charge transport considerations. The amount of small molecule transport material that may be employed in the separate interface layer is preferably between about 1 and about 20 percent by weight small molecule transport material, based on the total weight of the interface layer. Unlike the charge transport layer, a larger proportion of the small molecule transport material can be added to the thin interface layer without significantly impeding the flow of charge during imagewise exposure.

The charge transport layer should be an insulator to the extent that the electrostatic charge placed on the charge transport layer is not conducted in the absence of illumination at a rate sufficient to prevent formation and retention of an electrostatic latent image thereon. In general, the ratio of the thickness of the charge transport layer to the charge generator layer is preferably maintained from about 2:1 to 200:1 and in some instances as great as 400:1.

Optionally, an overcoate layer may also be utilized to improve resistance to abrasion. These overcoating layers may comprise organic polymers or inorganic polymers that are electrically insulating or slightly semi-conductive.

The photoreceptors of this invention provide an electrophotographic imaging member with improved resistance to delamination. In addition, markedly extends the cycling by reducing photoreceptor charge injection dark decay.

A number of examples are set forth hereinbelow and are illustrative of different compositions and conditions that can be utilized in practicing the invention. All proportions are by weight unless otherwise indicated. It will be apparent, however, that the invention can be practiced with many types of compositions and can have many different uses in accordance with the disclosure and as pointed out hereinafter.

EXAMPLE I

A photoconductive imaging member was prepared by providing an aluminized polyethylene terephthalate (Mylar available from E. I. duPont de Nemours & Co.) substrate having a thickness of 3 mils and applying thereto, using a Bird applicator, a solution containing 0.4 gm 3-aminopropyltriethoxysilane, 90 gm of 200 proof alcohol and 10 gm water. This layer was then allowed to dry for 5 minutes at room temperature and 10 minutes at 135° C. in a forced air oven. The resulting blocking layer had a dry thickness of 0.02 micrometer.

An adhesive interface layer was then prepared by applying to the blocking layer a coating having a wet thickness of 0.5 mil and containing 0.5 percent by weight based on the total weight of the solution of polyester adhesive (DuPont 49,000, available from E. I. duPont de Nemours & Co.) in a 70:30 volume ratio mixture of tetrahydrofuran/cyclohexanone with a Bird applicator. The adhesive interface layer was allowed to dry for 1 minute at room temperature and 10 minutes at 100° C. in a forced air oven. The resulting adhesive interface layer had a dry thickness of 0.05 micrometer.

The adhesive interface layer was thereafter coated with a photogenerating layer of $As_2Se_3$. $As_2Se_3$ was vacuum deposited by heating an alloy of selenium containing 40 percent by weight arsenic in a vacuum at $10^{-6}$ Torr to form a photogenerating layer having a thickness of 0.15 micron.

This photogenerator layer was overcoated with a charge transport layer. The charge transport layer was prepared by introducing into an amber glass bottle in a weight ratio of 1:1 N,N'-diphenyl-N,N'-bis(3-methylphenyl)-1,1'-biphenyl-4,4'-diamine and Makrolon R, a polycarbonate resin having a molecular weight of from about 50,000 to 100,000 commercially available from Farbensabricken Bayer A. G. The resulting mixture was dissolved in methylene chloride to form a solution containing 15 percent by weight solids. This solution was applied on the photogenerator layer using a Bird applicator to form a coating which upon drying had a thickness of 25 microns. The resulting photoreceptor device containing all of the above layers was annealed at 135° C. in a forced air oven for 6 minutes.

The coated photoreceptor was cycled in a Xerox Scanning machine for 10,000 cycles. It was found that the photoinduced discharge characteristics remained stable for the 10,000 cycles. Also, when the coated photoreceptor was flexed around a 2 cm diameter roll 100 times, the transport layer delaminated from the generator layer.

EXAMPLE II

A photoconductive imaging member was prepared in the same manner and with the same proportions of materials as in Example I except that the transport layer solution used in Example I was modified by the addition of 8 percent by weight phenolic epoxy (ECN 1299, available from CIBA Chemical & Dye Co.) based on the total weight of solids. This solution was applied on the photogenerator layer using a Bird applicator to form a coating which upon drying had a thickness of 25 microns. The resulting photoreceptor device containing all of the above layers was annealed at 135° C. in a forced air oven for 6 minutes.

The coated photoreceptor was cycled in a Xerox Scanning machine for 10,000 cycles. It was found that the photoinduced discharge characteristics remained stable for the 10,000 cycles. When the coated photoreceptor was flexed around a 2 cm diameter roll 1,000 times, the transport layer did not delaminate from the generator layer. A comparison of the results obtained in Examples I and II clearly indicate that the adhesion between the generator and transport layer of the photoreceptor of this invention was improved without any impact on the electrophotographic properties.

EXAMPLE III

A photoconductive imaging member was prepared in the same manner and with the same proportions of materials as in Example I except that an interface layer was coated between the generator and transport layers. The interface layer contained 1 gram of an epoxy novolac (DEN 438, available from Dow Chemical Co.), 100 m grams of N,N'-diphenyl-N,N'-bis(3-methylphenyl)-1,1'-biphenyl-4,4'-diamine and 99 grams of tetrahydrofuran. This mixture was coated with a Bird applicator and dried for 10 minutes at 100° C. in a forced dry air oven to form an interface layer having a dried thickness of 0.1 micrometer.

The coated photoreceptor was cycled in a Xerox copying machine for 10,000 cycles. It was found that the photoinduced discharge characteristics remained stable for the 10,000 cycles. Also, when the photoreceptor was flexed around a 2 cm diameter roll 1,000 times, the transport layer did not delaminate from the generator layer. Examples I and III clearly demonstrate that the adhesion between the generator layer and the transport layer is improved without any impact on the electrophotograhic properties.

EXAMPLE IV

A photoconductive imaging member was prepared in the same manner and with the same proportions of materials as in Example II except that the additive was 8 percent by weight of polyester (PE 200, Goodyear Tire & Rubber Co.). The resulting device showed excellent adhesion improvements compared to the device in Example I without any deterioration of electrophotographic properties.

EXAMPLE V

A photoconductive imaging member was prepared in the same manner and with the same proportions of materials as in Example III except that a polyester (49000, available from E. I. duPont de Nemours & Co.) was substituted for the epoxy novolac polymer. The solvent was methylene chloride instead of tetrahydrofuran. The proportions of polymer and solvent remained the same. The resulting device showed excellent adhesion improvements compared to the device in Example I without any deterioration of electrophotographic properties.

EXAMPLE VI

The devices of Examples I through V all contained a charge blocking layer of gamma amino propyltriethoxy silane. Identical photoreceptors were prepared using containing polyvinyl butyral as a blocking layer material instead of gamma amino propyltriethoxy silane. The blocking layer coating solution was prepared with 1 gram of polyvinyl butyral (B-72, available from Monsanto Co.) in 99 grams of ethanol/butanol in a ratio of 70:30. This coating mixture was applied with a Bird applicator and the resulting coating dried for 15 minutes at 100° C. in a forced dry air oven to form a layer having a dried thickness of 0.08 micrometer. The substitution of polyvinyl butyral for gamma amino propyltriethoxy silane in the blocking layer gave photoreceptors that performed in the same way as the corresponding photoreceptors in Examples I through V.

Although the invention has been described with reference to specific preferred embodiments, it is not intended to be limited thereto, rather those skilled in the art will recognize that variations and modifications may be made therein which are within the spirit of the invention and within the scope of the claims.

What is claimed is:

1. A cyclicable electrophotographic imaging member comprising a substrate having an electrically conductive surface, a charge generator layer, a charge transport layer comprising a polycarbonate film forming binder and a charge transporting small molecule, and an interface layer comprising a polymer and a charge transporting small molecule uniformly distributed along at least the interface between said charge generator layer and said charge transport layer, wherein said polymer is selected from the group consisting of a phenolic epoxy polymer represented by the following structure:

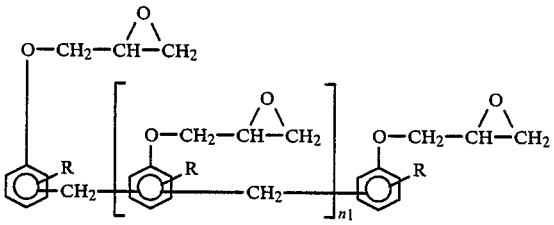

wherein R is hydrogen or an alkyl group containing from 1 to 8 carbon atoms and $n_1$ is a number from 1 to 8 and a polyester represented by the following structure:

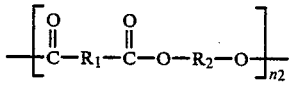

wherein $R_1$ and $R_2$ is an alkyl group having from 1 to 12 carbon atoms, a cycloalkyl group containing from 4 to 36 carbon atoms, an aryl group, or an alkylaryl group containing from 1 to 8 carbon atoms in the alkyl group and $n_2$ is a number from 4 to 1000.

2. A cyclicable electrophotographic imaging member according to claim 1 wherein said transport layer comprises a solid solution or molecular dispersion of between about 30 percent by weight and 50 percent by weight of said charge transporting small molecule, based on the total weight of said transport layer, about 0.5 percent by weight and 10 percent by weight of said phenolic epoxy polymer, based on the total weight of said transport layer, and said polycarbonate film forming binder.

3. A cyclicable electrophotographic imaging member according to claim 1 wherein said transport layer comprises a solid solution or molecular dispersion of between about 30 percent by weight and 50 percent by weight of said charge transporting small molecule, based on the total weight of said transport layer, about 0.5 percent by weight and 10 percent by weight of said polyester, based on the total weight of said transport layer, and said polycarbonate film forming binder.

4. A cyclicable electrophotographic imaging member according to claim 1 wherein said charge generator layer comprises a layer a vacuum deposited selenium material.

5. A cyclicable electrophotographic imaging member according to claim 4 wherein said charge generator layer comprises a layer of vacuum deposited $As_2Se_3$.

6. A cyclicable electrophotographic imaging member according to claim 1 wherein said charge generator layer comprises a layer of sublimed photoconductive material.

7. A cyclicable electrophotographic imaging member according to claim 1 wherein said phenolic epoxy polymer and charge transporting small molecule are in a thin interlayer at the interface between said charge generator layer and said charge transport layer.

8. A cyclicable electrophotographic imaging member according to claim 7 wherein said thin interlayer has a thickness between about 0.05 micrometer and about 2 micrometers.

9. A cyclicable electrophotographic imaging member according to claim 7 wherein the concentration of said transport molecule in said interlayer is between about 1 and about 20 percent by weight, based on the total weight of said interlayer.

10. A cyclicable electrophotographic imaging member according to claim 1 wherein said polyester and charge transporting small molecule are in a thin interlayer at the interface between said charge generator layer and said charge transport layer.

11. A cyclicable electrophotographic imaging member according to claim 10 wherein said thin interlayer has a thickness between about 0.5 micrometer and about 2 micrometers.

12. A cyclicable electrophotographic imaging member according to claim 10 wherein the concentration said transport molecule in said interlayer is between about 1 and about 20 percent by weight, based on the total weight of said interlayer.

13. A cyclicable electrophotographic imaging member according to claim 1 wherein a blocking layer is interposed between said substrate and said charge generator layer.

14. A cyclicable electrophotographic imaging member according to claim 13 wherein said blocking layer has a thickness of between about 0.005 micrometer and about 0.2 micrometer.

15. A cyclicable electrophotographic imaging member according to claim 13 wherein said blocking layer is selected from the group consisting of an amino siloxane, polyvinyl butyral and polyvinyl pyrrolidone.

16. A cyclicable electrophotographic imaging member according to claim 1 wherein said blocking layer is selected from the group consisting of an amino siloxane, polyvinyl butyral and polyvinyl pyrrolidone, said charge generator layer comprises vacuum deposited $As_2Se_3$, and said charge transport layer comprises said polycarbonate film forming binder and a diamine charge transport molecule represented by the following formula

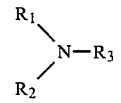

wherein $R_1$ and $R_2$ are an aromatic group selected from the group consisting of a substituted or unsubstituted phenyl group, naphthyl group, and polyphenyl group and $R_3$ is selected from the group consisting of a substituted or unsubstituted aryl group, alkyl group having from 1 to 18 carbon atoms and cycloaliphatic compounds having from 3 to 18 carbon atoms.

17. A cyclicable electrophotographic imaging member according to claim 1 wherein said charge generator layer is between said electrically conductive surface and said charge transport layer.

18. A cyclicable electrophotographic imaging member according to claim 1 wherein said charge transport layer is between said electrically conductive surface and said charge generator layer.

19. A cyclicable electrophotographic imaging member comprising a substrate having an electrically conductive surface, a blocking layer, a charge generator layer comprising a vacuum deposited or sublimed charge generator material, a charge transport layer comprising a polycarbonate film forming binder and a charge transporting small molecule, and an interface layer comprising a polymer and a charge transporting small molecule uniformly distributed along at least the interface between said charge generator layer and said charge transport layer, wherein said polymer comprises a phenolic epoxy polymer represented by the following structure:

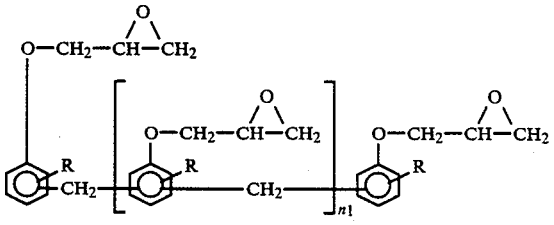

wherein R is hydrogen or an alkyl group containing from 1 to 8 carbon atoms and $n_1$ is a number from 1 to 8.

20. An imaging process comprising providing an electrophotographic imaging member comprising a substrate having an electrically conductive surface, a charge generator layer, a charge transport layer comprising a polycarbonate film forming binder and a charge transporting small molecule, and an interface layer comprising a polymer and a charge transporting small molecule uniformly distributed along at least the interface between said charge generator layer and said charge transport layer, wherein said polymer is selected from the group consisting of a phenolic epoxy polymer represented by the following structure:

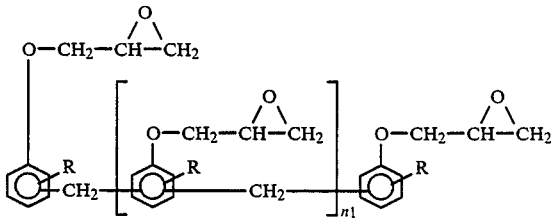

wherein R is hydrogen or an alkyl group containing from 1 to 8 carbon atoms and $n_1$ is a number from 1 to 8 and a polyester represented by the following structure:

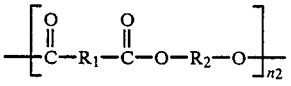

wherein $R_1$ and $R_2$ is an alkyl group having from 1 to 12 carbon atoms, a cycloalkyl group containing from 4 to 36 carbon atoms, an aryl group, or an alkylaryl group containing from 1 to 8 carbon atoms in the alkyl group and $n_2$ is a number from 4 to 1000, forming an electrostatic latent image on said imaging member depositing a toner image on said imaging member in conformance with said electrostatic latent image, transferring said toner image to a receiving member and repeating said forming, depositing and transfer steps at least once.

* * * * *